US005644553A

United States Patent [19]

Cuinet

[11] Patent Number: 5,644,553

[45] Date of Patent: Jul. 1, 1997

[54] COMBINED CROWN/PUSHBUTTON FOR ILLUMINATED ANALOG WATCH

[75] Inventor: Jean Louis Cuinet, Recologne, France

[73] Assignee: Timex Corporation, Middlebury, Conn.

[21] Appl. No.: 387,692

[22] Filed: Feb. 13, 1995

[51] Int. Cl.[6] ..... G04C 3/00

[52] U.S. Cl. ..... 368/320; 368/190

[58] Field of Search ..... 368/77, 188, 187, 368/306, 308, 319, 320, 321

[56] References Cited

U.S. PATENT DOCUMENTS

| | | | |
|---|---|---|---|
| 3,526,088 | 9/1970 | Meitinger | 58/23 |
| 3,832,843 | 9/1974 | Wuthrich | 58/57.5 |
| 4,023,002 | 5/1977 | Wuthrich et al. | 200/159 |
| 4,031,341 | 6/1977 | Wuthrich et al. | 200/52 |
| 4,126,992 | 11/1978 | Yasuda | 58/88 |
| 4,182,111 | 1/1980 | Tamaru | 58/23 |
| 4,415,277 | 11/1983 | Ganter | 368/190 |
| 4,536,095 | 8/1985 | Wuthrich | 368/321 |
| 4,794,576 | 12/1988 | Schwartz et al. | 368/185 |
| 5,305,291 | 4/1994 | Kamens et al. | 368/252 |

FOREIGN PATENT DOCUMENTS

| | | | |
|---|---|---|---|
| 1203096 | 1/1960 | France . | |
| 2296211 | 7/1976 | France | G04B 27/00 |

*Primary Examiner*—Bernard Roskoski
*Attorney, Agent, or Firm*—William C. Crutcher

[57] ABSTRACT

A combination crown and pushbutton for an illuminated analog watch having a manual actuator on the setting stem external to the watchcase for pulling out the stem and manually rotating it to set the hands. The watch has an electroluminescent dial which lights up when a switch is closed. An axially elongated detent recess in the stem allows the stem to move inward when the actuator is pushed. A spring switching arm maintains the actuator in the normal run position and closes a switch when the actuator is pushed. Thus a separate pushbutton is not needed.

8 Claims, 4 Drawing Sheets

COMBINED CROWN/PUSHBUTTON FOR ILLUMINATED ANALOG WATCH

BACKGROUND OF THE INVENTION

This invention relates generally to illuminated analog wristwatches requiring a manually operated crown to set the timekeeping hands, and also requiring a manually operated pushbutton to illuminate the wristwatch. More particularly, the invention relates to an improvement in an illuminated analog watch of the type having a watchcase, a movement disposed in the watchcase having a gear train and hands operated by the gear train, means for illuminating the watch in response to closure of a switch, a rotatable stem slidably disposed in the movement, a crown actuator disposed on the stem external to the watchcase for manually rotating and sliding the stem, a setting pinion disposed on the stem adapted to engage the gear train when the crown is pulled from a normal "run" position to an outer "setting" position for setting the hands, and a detent spring cooperating with the stem to temporarily hold the stem in the outer setting position.

Normally, an analog wristwatch includes a crown setting mechanism with an external manually operated crown disposed in the vicinity of the three o'clock position. The crown may be pulled from its normal run position to a setting position, in which a setting pinion on the stem engages teeth on a setting gear which meshes with the gear train, so that the time indicating hands may be rotated by rotating the crown to set the time. Such an arrangement is well known in the art, and in the case of three hand watches, may also include a slip friction clutch in the gear train permitting the gears carrying the hour hand and minute hand to rotate while the seconds wheel is held stationary by a mechanical brake. An example of such an arrangement is seen in FIG. 3 of U.S. Pat. No. 4,794,576 issued Dec. 27, 1988 to Schwartz et al. and assigned to the present assignee.

Various types of early wristwatches have provided for illumination of the timekeeping indicia by incandescent bulbs, and there is a growing use of electroluminescent illumination in wristwatches. U.S. Pat. No. 4,775,964 issued Oct. 4, 1988 to Alessio et al. and assigned to the present assignee, describes an electroluminescent device adapted to serve as the dial of an analog timepiece when a pushbutton is actuated to operate switch contacts. The constructions of manually operated external pushbutton actuators adapted to close switch contacts inside the watchcase are also well known. Examples are shown in U.S. Pat. No. 3,526,088 issued Sep. 1, 1970 to H. Meitinger, U.S. Pat. No. 4,023,002 issued May 10, 1974 to P. Wuthrich et al., and U.S. Pat. No. 4,031,341 issued Jun. 21, 1977 to P. Wuthrich et al. All of the aforesaid patents are assigned to the present assignee, and illustrate various means for spring biasing the pushbuttons, while sealing the pushbutton stems against entry of moisture.

Heretofore, the hand setting mechanism has been operated by the watch crown at one location on the watchcase and the illumination of the watch has been operated by a separate pushbutton at a different location on the watch. This requires at least two external members, need for two apertures with water-tight seals and generally adds to the cost of the timepiece. The presence of two external members, one of which is seldom used, has led to the possibility of combining the functions so that they may be operated by a single external member.

Accordingly, one object of the present invention is to provide an improvement in the crown setting mechanism and the pushbutton actuator for an illuminated analog wristwatch.

Another object of the invention is to provide an improved combined crown and pushbutton for an illuminated analog watch.

DRAWINGS

The invention will best be understood by reference to the following description, taken in connection with the accompanying drawings, in which:

FIG. 1 is a side elevational drawing in cross-section of a portion of an illuminated analog wristwatch assembly, taken through the axis of the manual actuator and setting stem, FIG. 2 is a perspective view of the movement from the movement side (inverted from FIG. 1) with the actuator attached but omitting the watchcase, FIGS. 3, 4 and 5 cross-sectional side elevational drawings of one side of a watch movement, taken through the axis of the setting stem with the stem illustrated in three different axial positions, and FIGS. 6, 7, 8 and 9 are cross-sectional, side elevational views of one side of another movement used in a calendar watch, taken through the axis of the setting stem and illustrating the stem in four different axial positions.

SUMMARY OF THE INVENTION

Briefly stated, the invention comprises an improved crown and pushbutton for an illuminated analog watch of the type having a watchcase, a movement disposed in the watchcase having a gear train and hands operated by the gear train, means for illuminating the watch in response to closure of a switch, a rotatable stem slidably disposed in the movement, a crown actuator disposed on the stem external to the watchcase for manually rotating and sliding the stem, a setting pinion disposed on the stem adapted to engage the gear train when the crown is pulled from a normal run position to an outer setting position for setting the hands, and a detent spring cooperating with the stem to temporarily hold the stem in the outer setting position.

The improvement comprises furnishing an axially elongated detent recess on the stem arranged to cooperate with the detent spring to allow a pre-selected range of axial movement of the stem during which the hands are operated by the gear train, from its normal "run" position to an axially inner "switching" position. A first contact terminal adjacent the stem is connected as one side of the illuminating switch, and a spring switching arm is adapted to cooperate with the stem so as to bias it axially outward toward the "run" position, and a second contact terminal spaced from the first contact terminal and connected so as to serve as the other side of the switch. When the external crown is pushed against the biasing force of the spring switching arm, the switching arm is arranged to cause the second contact terminal to make contact with the first contact terminal when the stem is moved within the preselected range of axial movement. Preferably, the second contact is mounted on, or a part of, the switching arm.

The invention is illustrated for a three position stem assembly providing a run position, a setting position and a switching position to illuminate the wristwatch. It is also illustrated in a calendar wristwatch movement with an additional intermediate axial position for changing the calendar date.

DESCRIPTION OF THE PREFERRED EMBODIMENT

Figure 1:
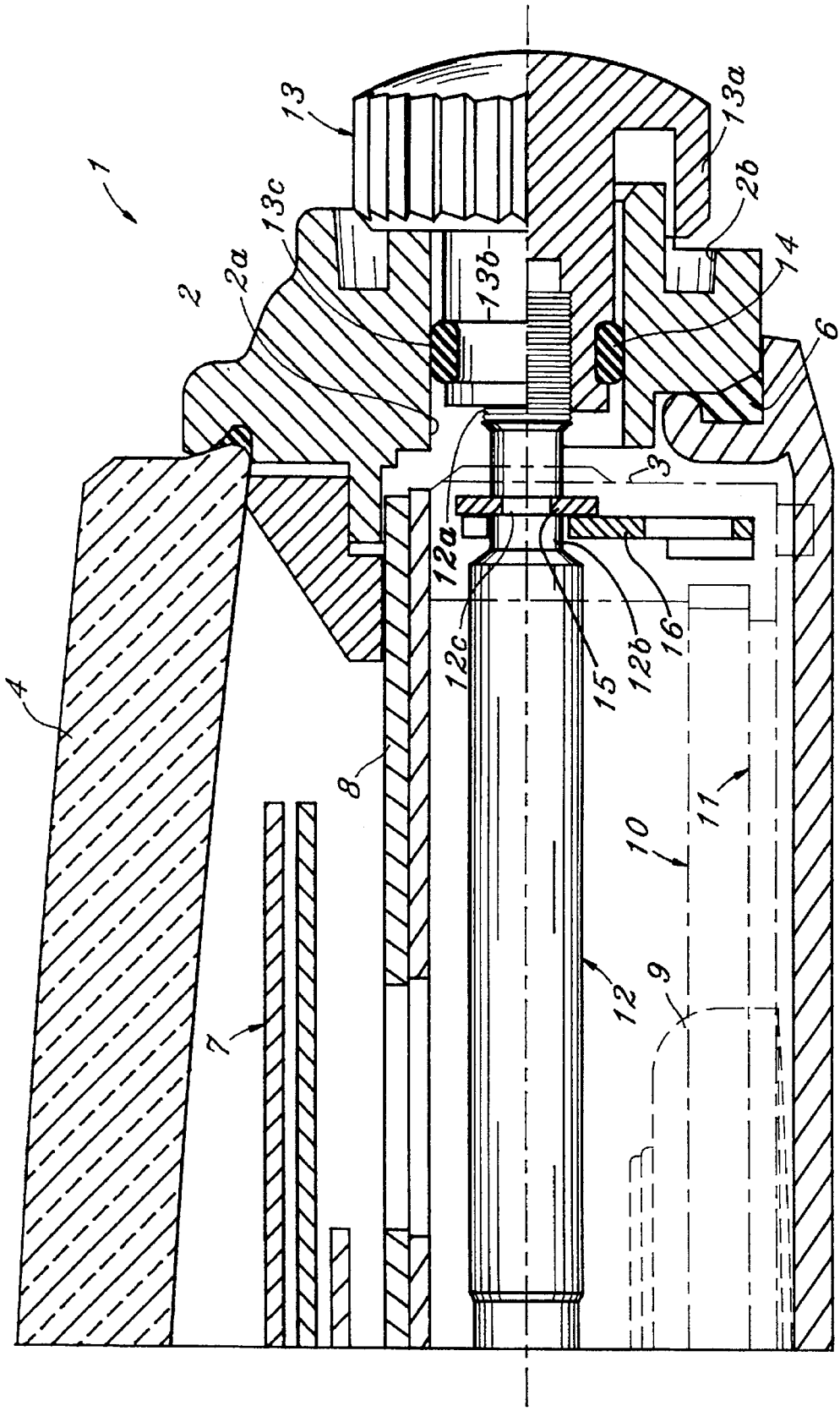

Referring now to FIG. 1 of the drawing, an illuminated analog wristwatch, shown generally as 1, comprises a watchcase 2 containing a movement shown in outline form at 3. Watchcase 2 is provided with a transparent lens 4 and caseback 5 with a sealing gasket 6 in a conventional construction. The movement 3 includes a timekeeping gear train (not shown) operatively connected to a stepping motor (not shown) drive watch hands 7 above a dial 8 supported on movement 3. Movement 3 contains an energy cell 9 connected to various electronic components to supply power to the stepping motor driving the gear train, and also to supply power to an electroluminescent circuit providing illumination for the dial 8. The aforesaid components are carried on a printed circuit board (PCB) 10 held in place by an electrically conductive spring plate 11. The details of the electrical circuits are not relevant to the present invention, except to note that an electroluminescent drive circuit is provided on the PCB which causes illumination of analog watch dial 8 when a switch is closed.

A setting stem 12, only a portion of which is seen in FIG. 1, is rotatably mounted and axially slidable within the movement 3. The end of stem 12 is threaded at 12*a* and extends into an opening 2*a* in watchcase 2. An external crown/pushbutton manual actuator 13 is disposed on the outside of watchcase 2. Actuator 13 includes a knurled peripheral flange 13*a* connected to a central stub 13*b* having internal threads and fitted with an external sealing groove 13*c*. An O-ring gasket 14 allows the actuator 13 to slide axially as well as rotate while preventing the entrance of dirt and moisture through the watchcase opening 2*a*. A circular recess 2*b* in the watchcase coaxial with flange 13*a* allows the actuator 13 to be pushed inward without interfering with the flange 13*a*.

Stem 12 has a neck 12*b* with a groove 12*c* in which is disposed a snap-fit retaining member 15. A resilient spring switching arm 16, which is supported from movement 3, extends to neck 12*b* of the stem and provides a biasing spring force against retaining member 15 pushing stem 12 axially in an outward direction. Stem 12 is prevented from moving outward by other structure to be discussed later, so that it is retained in the "run" or normal position illustrated in FIG. 1.

Figure 2:
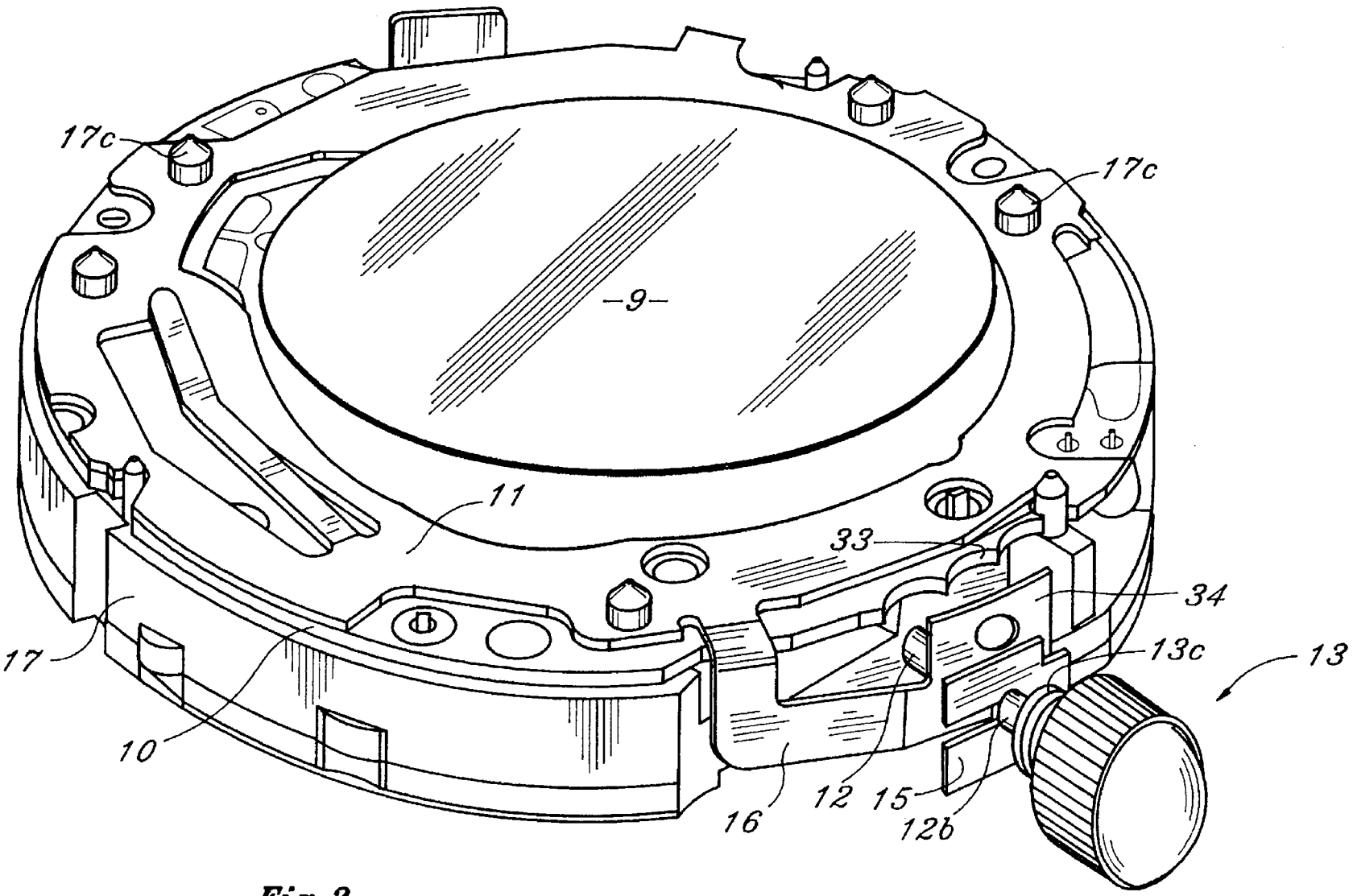

Referring to the perspective view of FIG. 2, movement 3 is shown inverted to illustrate the printed circuit board 10 being retained on a frame 17 by the spring plate 11. The frame 17 is of plastic material and includes a number of posts 17*c* which are upset by ultrasonic welding. The resilient switching arm 16 is made by folding a tab down from the metal spring plate 11 and arranging it so that it will surround the neck 12*b* of the stem, so as to be engagable by the retaining member 15 on stem neck 12*b*.

PCB 10 is of insulating material, but includes a peripheral conductive insert forming a first contact terminal 33 which is connected to other elements of the circuit. Another or second contact terminal 34 forming the second member of a switch is provided by an upward extension from resilient spring arm 16 and is spaced from contact terminal 33. While the second contact terminal is shown disposed on the spring arm 16, it could also be a separate member interposed between spring arm 16 and contact terminal 33, and connected to ground.

Figure 3:
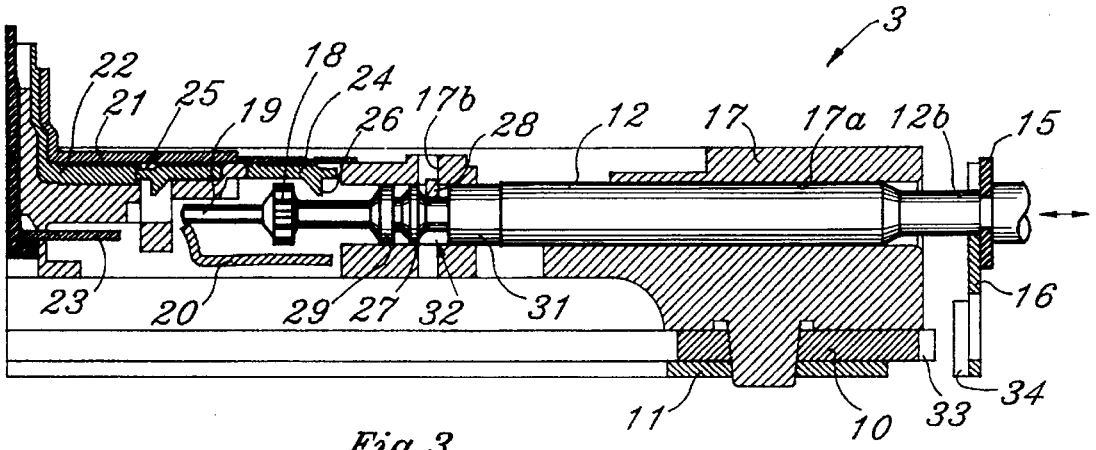
Figure 4:
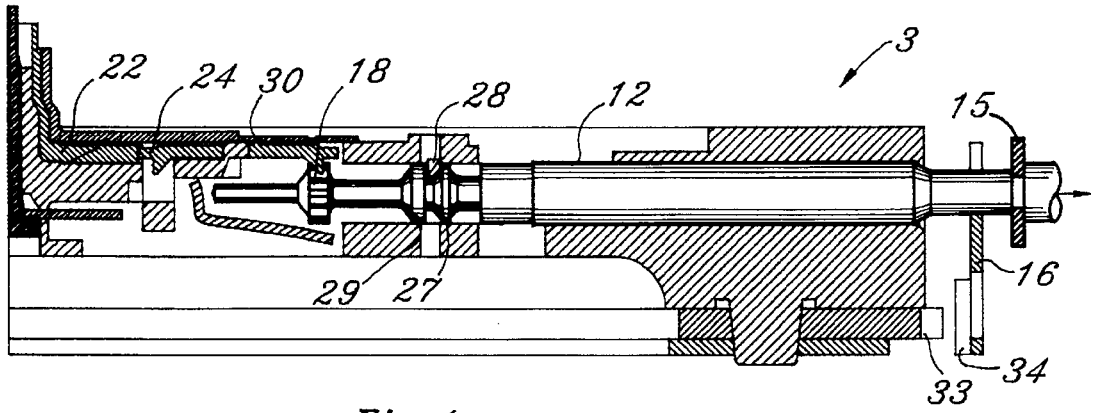
Figure 5:
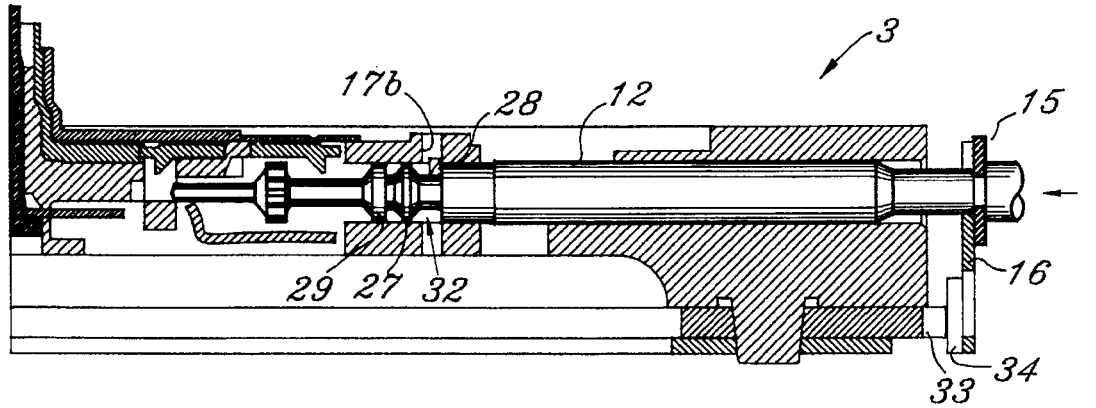

Referring now to FIGS. 3, 4, and 5 of the drawings, the same elements are illustrated in each of the cross-sectional elevational drawings, the only difference between the figures being in the axial position of the stem 12. The watchcase, dial, hands and actuator 13 are omitted for purpose of clarity. In FIG. 3 stem 12 is illustrated in the normal or "run" position. In FIG. 4, stem 12 is illustrated having been pulled axially outward from the movement into the "setting" position. In FIG. 5, the stem has been pushed axially inward toward the movement into the "switching" position.

The components illustrated in FIGS. 3, 4 and 5 are a frame 17 having a bore 17*a* within which stem 12 is axially slidable and also rotatable. Stem 12 carries a setting pinion 18 and a stem extension stub 19, which makes grounding contact with a spring contact member 20. Frame 17 carries gear train elements such as an hour wheel 21, a center wheel 22 and a seconds wheel 23, all having concentric shafts carrying the timekeeping hands (not shown). A setting gear 24 has spur teeth engaging the center wheel at 25, and also has crown teeth 26 adapted to mesh with the setting pinion 18 when the stem 12 is in the FIG. 4 setting position.

Stem 12 carries a detent flange 27 beveled with a frustoconical surface on either side thereof to cooperate with a detent spring 28. Detent spring 28 is mounted so that it can rise into a slot 17*b* in the frame when stem 12 is slid axially. Stem 12 also includes a flat-faced retaining flange 29. Flanges 27 and 29 establish a detent groove between them receiving the detent spring 28 so as to temporarily hold stem 12 in the setting position as shown in FIG. 4. When in this position, time setting pinion 18 is engaged with the crown teeth of setting gear 24. A spring holding plate 30 may be included to assist in holding the gears 18, 24 in mesh and movable to prevent damage if they do not mesh properly when engaged.

The foregoing elements heretofore described are known, and may be found in the aforementioned U.S. Pat. No. 4,794,576. Turning now to the improvement of the present invention, stem 12 is provided with a blocking flange 31 which has a flat radial face spaced from the detent flange 27, so as to provide an axially elongated detent recess 32. The detent recess 32 provides a pre-selected range of axial movement of the stem during which the hands are operated by the gear train in a normal manner while the detent spring 28 traverses detent recess 32. FIG. 3 illustrates detent spring 28 in the left hand end of detent recess 32, whereas FIG. 5 illustrates detent spring 28 in the right hand end of detent recess 32.

In accordance with the other aspect of the present invention, the first contact terminal 33 is disposed adjacent stem 12, and the second contact terminal 34, which may be part of the switching arm 16 is spaced from the first contact terminal 33. The axial spacing is selected to be less than the axial travel of stem 12 permitted by the aforementioned detent recess 32.

The invention operates as follows. In the run position illustrated in FIG. 3, spring switching arm 16 presses against retaining member 15 and is trying to push stem 12 to the right, but it is prevented from moving by detent spring 28 riding against detent flange 27.

In FIG. 4, stem 12 has been pulled manually by the actuator 13 to overcome the detent spring force. This relocates detent spring 28 between flanges 27, 29 and the engaged setting pinion 18 now permits the crown actuator 13 to be rotated so as to set the watch hands.

In FIG. 5, stem 12 has been pushed to the left from the normal "run" position of FIG. 3 against the biasing force of spring switching arm 16. Slightly before detent spring 28 engages stopping flange 31 to prevent further leftward movement of stem 12, contacts 33, 34 close the switch to illuminate the wristwatch. When actuator 13 is released, switching spring 16 causes the stem to move to the right, back to the position shown in FIG. 3.

Figure 6:
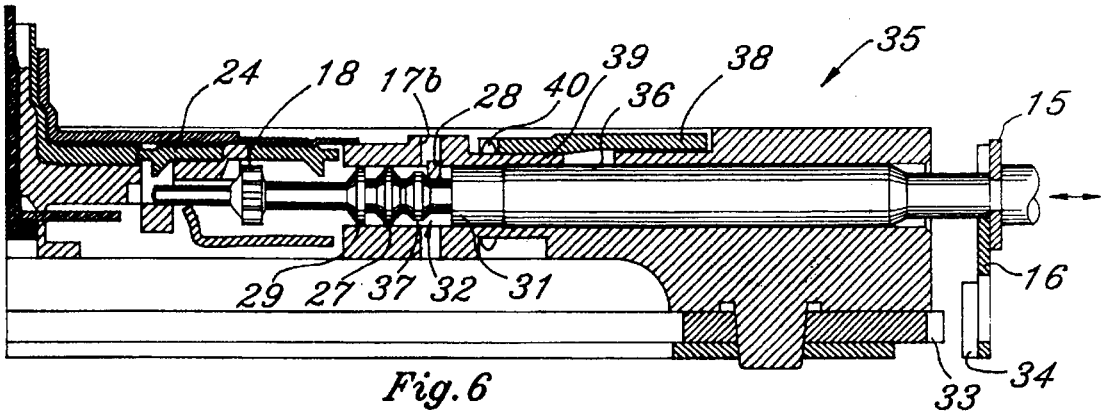

A variation of the invention is illustrated in FIGS. 6, 7, 8 and 9. A different movement 35 is illustrated for a calendar watch. FIG. 6 is the "run" position with a watch stem 36 shown having an additional detent flange 37, and having a date ring 38 rotatably carried in movement 35. A sleeve 39 making frictional engagement with the stem 36 includes radial teeth 40 meshing with inner spur teeth on date ring 38.

Figure 7:
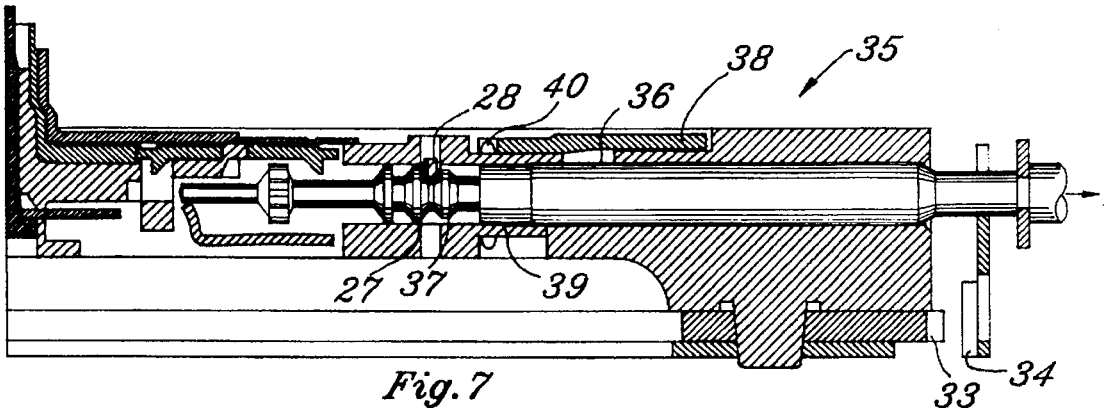

Referring to FIG. 7, the additional detent flange 37 establishes together with detent flange 27 and detent spring 28 an axially intermediate date setting position between the run position and the setting position. Rotation of stem 36 through frictional engagement with sleeve 39, causes sleeve 39 to rotate and to advance or reverse the date ring 38.

Figure 8:
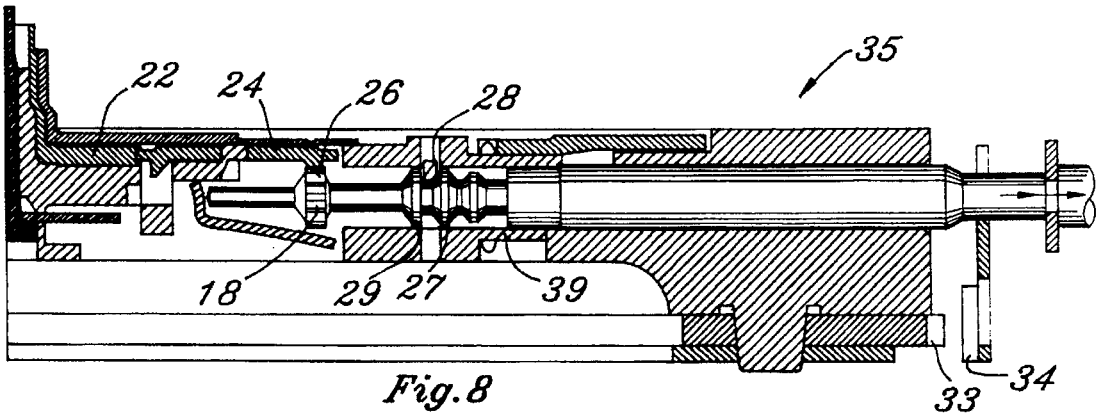

Reference to FIG. 8 illustrates the stem 36 pulled out to the next or setting detenting position which is established by the detent spring 28 resting between flanges 29, 27 as before. Setting pinion 18 is engaged with setting wheel 24 and rotation of stem 36 sets the watch hands as before.

Figure 9:
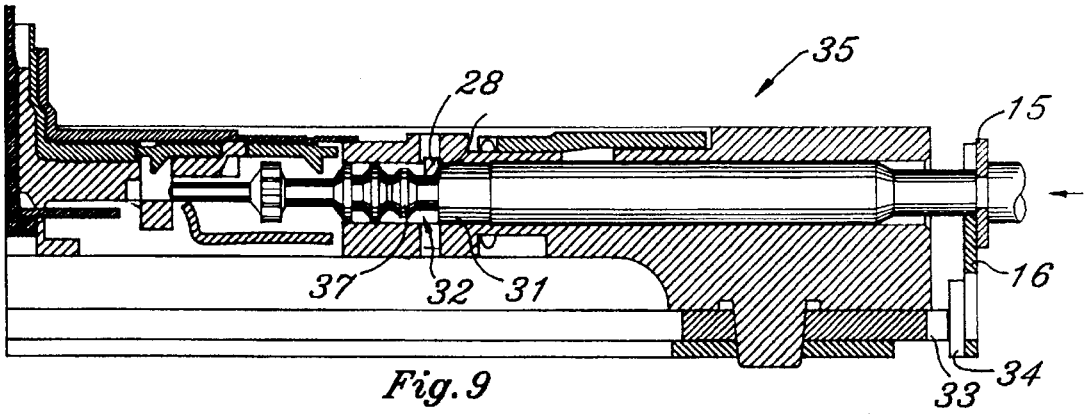

Reference to FIG. 9 shows an axially elongated detent recess 40, according to the present invention, which is now established between the additional detent flange 37 and blocking flange 31. Detent recess 40 permits a preselected range of axial movement of stem 36 which is slightly greater than the spacing between the first contact member 33 and the first contact member 34 as previously described.

Equivalent structures providing the axial movement of the stem afforded by detent spring 28 and axially elongated detent recesses 32, 40 will be apparent to those skilled in the art, and are intended to be covered in the appended claims.

Thus there has been described an improved crown/pushbutton which combines into one actuator the setting and illumination functions which previously required separate actuators.

While there has been described what is considered to be the preferred embodiment of the invention, other modifications will occur to those skilled in the art, and it is desired to secure in the appended claims all such modifications as fall within the true spirit and scope of the invention.

I claim:

1. An improved crown and pushbutton for an illuminated analog watch of the type having a watchcase, a movement disposed in the watchcase having a gear train and hands operated by the gear train, means for illuminating the watch in response to closure of a switch, a rotatable stem slidably disposed in the movement, a crown actuator disposed on the stem external to the watchcase for manually rotating and sliding the stem, a time setting pinion disposed on the stem adapted to engage the gear train when the crown is pulled to an outer setting position for setting the hands, and a detent spring cooperating with the stem to temporarily hold the stem in the outer setting position, said improvement comprising:

an axially elongated detent recess defined by said stem arranged to cooperate with said detent spring to allow a preselected range of axial movement of said stem without engaging said gear train during which said hands are operated by said gear train, between a normal run position and an axially inner switching position, a first contact terminal adjacent said stem connected as one side of said switch, a spring switching arm adapted to cooperate with said stem and bias it axially outward toward said run position, a second contact terminal spaced from said first contact terminal connected as the other side of said switch, said switching arm being arranged to cause the second contact terminal to make contact with the first contact terminal when said stem is moved within said preselected range of axial movement by pushing said crown against the biasing force of said spring switching arm.

2. The combination according to claim 1, wherein said stem defines at least one detent flange having frusto-conical surfaces on either side thereof, and a blocking flange spaced therefrom to define said detent recess.

3. The combination according to claim 2, wherein said stem defines a retaining flange on the opposite side of a detent flange from said blocking flange, said retaining flange and said detent flange defining a groove therebetween establishing said outer setting position.

4. The combination according to claim 2, wherein said stem defines at least two detent flanges on the opposite side of said detent flange from said blocking flange, said detent flanges defining a groove therebetween establishing an axially intermediate date setting position.

5. The combination according to claim 1, wherein said movement includes a printed circuit board having said first contact terminal disposed on a peripheral edge thereof, and further includes a conductive spring plate retaining said printed circuit board, said spring switching arm being formed as a part of said conductive spring plate and spaced from said first contact terminal to provide said second contact terminal.

6. The combination according to claim 1, including a retaining member attached to said stem and adapted to contact said spring switching arm to transmit spring biasing force from the switching arm to the stem.

7. The combination according to claim 1, wherein said second contact terminal is disposed on said spring switching arm.

8. An improved crown and pushbutton for an illuminated analog watch of the type having a watchcase, a movement having a frame disposed in the watchcase and having a gear train and hands operated by the gear train, means for illuminating the watch in response to closure of a switch, a rotatable stem slidably disposed in the frame, a crown actuator disposed on the stem external to the watchcase for manually rotating and sliding the stem, a time setting pinion disposed on the stem adapted to engage the gear train when the crown is pulled to an outer setting position for setting the hands, and a detent spring cooperating with the stem to temporarily hold the stem in the outer setting position, said improvement comprising:

a detent flange defined by said stem having frusto-conical surfaces on either side thereof and a blocking flange defined by said stem, said detent flange and said blocking flange defining an axially elongated detent recess arranged to cooperate with said detent spring so as to allow a preselected range of axial movement of said stem without engaging said gear train, a printed circuit board disposed on said frame having a conductive portion on a peripheral edge thereof defining said first contact terminal, a conductive spring plate arranged to retain said printed circuit board on said frame, said spring switching arm being formed as part of said spring plate and spaced from said first contact terminal to provide said second contact terminal, and a retaining member attached to said stem and adapted to contact said spring switching arm to transmit spring biasing force from the switching arm to the stem.

* * * * *